US009972251B2

(12) United States Patent
Ryu et al.

(10) Patent No.: US 9,972,251 B2
(45) Date of Patent: May 15, 2018

(54) METHOD OF DRIVING ORGANIC LIGHT EMITTING DIODE DISPLAY

(71) Applicant: LG DISPLAY CO., LTD., Seoul (KR)

(72) Inventors: Ho-Jin Ryu, Goyang-si (KR); Seong-Hyun Kim, Jeonju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days. days.

(21) Appl. No.: 15/217,143

(22) Filed: Jul. 22, 2016

(65) Prior Publication Data

US 2017/0025069 A1 Jan. 26, 2017

(30) Foreign Application Priority Data

Jul. 23, 2015 (KR) ..... 10-2015-0104280

(51) Int. Cl.

| | |
|---|---|
| ***G09G 3/30*** | (2006.01) |
| ***G09G 3/3266*** | (2016.01) |
| ***G09G 3/3233*** | (2016.01) |
| ***G09G 3/3291*** | (2016.01) |
| *G09G 3/20* | (2006.01) |

(52) U.S. Cl.

CPC ..... *G09G 3/3266* (2013.01); *G09G 3/3233* (2013.01); *G09G 3/3291* (2013.01); *G09G 3/2081* (2013.01); *G09G 2310/0205* (2013.01); *G09G 2310/0251* (2013.01); *G09G 2320/045* (2013.01)

(58) Field of Classification Search

CPC .. G09G 3/3266; G09G 3/3291; G09G 3/3233; G09G 2320/045; G09G 2310/0251; G09G 2310/0205; G09G 3/2081

See application file for complete search history.

(56) References Cited

U.S. PATENT DOCUMENTS

| | | | | |
|---|---|---|---|---|
| 8,803,953 | B2 * | 8/2014 | Park | H04N 13/0497 348/43 |
| 9,761,166 | B2 * | 9/2017 | Gu | G09G 3/2003 |
| 2001/0003448 | A1 | 6/2001 | Nose et al. | |
| 2008/0238897 | A1 | 10/2008 | Kimura | |
| 2009/0262101 | A1 | 10/2009 | Nathan et al. | |
| 2010/0091006 | A1 | 4/2010 | Yoo et al. | |
| 2011/0157123 | A1 * | 6/2011 | Cho | G09G 3/3266 345/211 |
| 2011/0157132 | A1 * | 6/2011 | Byun | G09G 3/3677 345/211 |
| 2012/0013610 | A1 * | 1/2012 | Chae | G02B 27/22 345/419 |
| 2012/0038585 | A1 * | 2/2012 | Kim | G06F 3/0412 345/174 |
| 2012/0050274 | A1 * | 3/2012 | Yoo | G09G 3/003 345/419 |
| 2012/0162173 | A1 * | 6/2012 | Tseng | G09G 3/3648 345/211 |
| 2012/0235973 | A1 | 9/2012 | Yoo | |

(Continued)

*Primary Examiner* — Erin M File

(74) *Attorney, Agent, or Firm* — Dentons US LLP

(57) ABSTRACT

Disclosed is a method of driving an organic light emitting diode display that includes a first organic light emitting diode, and a first driving circuit to operate the first organic light emitting diode, the method includes supplying a first gate pulse and a second gate pulse to a first gate line connected to the first driving circuit, and supplying a first data signal and a first compensation signal to a data line connected to the first driving circuit.

26 Claims, 9 Drawing Sheets

(56) References Cited

U.S. PATENT DOCUMENTS

| | | | | |
|---|---|---|---|---|
| 2013/0342478 | A1* | 12/2013 | Bae | G06F 3/041 345/173 |
| 2014/0062985 | A1* | 3/2014 | Shin | G09G 3/3677 345/212 |
| 2015/0116009 | A1* | 4/2015 | Choi | H03K 17/165 327/109 |
| 2015/0187267 | A1* | 7/2015 | Park | G09G 3/3233 345/77 |
| 2015/0187854 | A1* | 7/2015 | Beak | H01L 27/3262 257/40 |
| 2015/0243724 | A1* | 8/2015 | Cho | H01L 29/7869 257/43 |
| 2015/0255012 | A1* | 9/2015 | Gu | H01L 27/3209 345/83 |

* cited by examiner

METHOD OF DRIVING ORGANIC LIGHT EMITTING DIODE DISPLAY

The present application claims the priority benefit of Korean Patent Application No. 10-2015-0104280 filed in Republic of Korea on Jul. 23, 2015, which is hereby incorporated by reference in its entirety for all purposes as if fully set forth herein.

BACKGROUND OF THE INVENTION

Field of the Invention

The present invention relates to an organic light emitting diode display (OLED) and a method of driving the same. In particular, the present invention relates to an OLED with improved image quality.

Discussion of the Related Art

Recently, flat display devices, such as a plasma display panel (PDP), a liquid crystal display (LCD), and an organic light emitting diode display (OLED), have been researched.

Among the flat display devices, the OLED is a self-luminescent device and can have a thin profile because the OLED does not need a backlight that is typically used for the LCD.

Further, compared with the LCD, the OLED has advantages of excellent viewing angle and contrast ratio, low power consumption, operation in low DC voltage, fast response speed, being resistant to an external impact because of its solid internal components, and wide operating temperature range.

Particularly, since the manufacturing process of the OLED is simple, the production costs of the OLED can be lower than that of the LCD.

FIG. 1 is a view illustrating organic light emitting diodes and driving circuits arranged in respective pixel regions of an OLED according to the related art, and FIG. 2 is a timing chart of gate pulses and data signals applied to the driving circuits of FIG. 1.

Referring to FIG. 1, the related art OLED includes first and second organic light emitting diodes D1 and D2 and first and second driving circuits 11 and 12 to operate the first and second organic light emitting diodes D1 and D2, respectively, in a display region 10.

In detail, the first driving circuit 11 is connected to a first gate line GL1 and each data line DL and operates the first organic light emitting diode D1, and the second driving circuit 12 is connected to a second gate line GL2 and each data line DL and operates the second organic light emitting diode D2.

For brevity, the first and second driving circuits 11 and 12 are shown in FIG. 1. However, a plurality of driving circuits may be arranged below the first and second driving circuits 11 and 12, and thus a plurality of gate lines may be arranged below the first and second gate lines GL1 and GL2 connected to the first and second driving circuits 11 and 12.

A method of driving the OLED is explained below.

The method of driving the OLED includes sequentially supplying first and second gate pulses g1 and g2 to the first and second gate lines GL1 and GL2, respectively, and sequentially supplying first and second data signals d1 and d2 to each data line DL.

Referring to FIG. 2, during a frame interval, the first gate pulse g1 is supplied to the first gate line GL1 and then the second gate pulse g2 is supplied to the second gate line GL2.

Further, the first and second data signals are sequentially supplied to the data lines DL per horizontal period H.

Further, the first data signal d1 is supplied to the first driving circuit 11 during an overlapping section between the first gate pulse g1 and the first data signal d1, and the second data signal d2 is supplied to the second driving circuit 12 during an overlapping section between the second gate pulse g2 and the second data signal d2.

Further, the first organic light emitting diode D1 emits light in a light-emission section from a falling point of the first gate pulse g1 during the present frame to a rising point of the first gate pulse g1 in the next frame, and the second organic light emitting diode D2 emits light in a light-emission section from a falling point of the second gate pulse g2 in the present frame to a rising point of the second gate pulse g2 during the next frame.

As shown in FIG. 1, the first driving circuit 11 is supplied with the first data signal d1 by the first gate pulse g1, and the second driving circuit 12 is supplied with the second data signal d2 by the second gate pulse g2.

In detail, the first driving circuit 11 is supplied with the first gate pulse g1 from the first gate line GL1 and the first data signal d1 from the data line DL to make the first organic light emitting diode D1 emit light.

Then, the second driving circuit 12 is supplied with the second gate pulse g2 from the second gate line GL2 and the second data signal d2 from the data line DL to make the second organic light emitting diode D2 emit light.

Unlike an LCD in which a thin film transistor is turned on only during a relatively short time in one frame interval, the OLED includes a driving thin film transistor in each of the first and second driving circuits 11 and 12 and maintains a turn-on state during a relatively long time in one frame interval. Accordingly, the driving thin film transistor of the OLED is prone to deterioration.

Accordingly, a threshold voltage (Vth) of the driving thin film transistor may vary, and this variation may negatively affect the display quality of the OLED.

In other words, because of the variation in threshold voltage (Vth), a gray level different from the target gray level of a data signal may be displayed, and thus the display quality of the OLED may deteriorate.

Further, when the organic light emitting diodes D1 and D2 emit light continuously during a certain time, the threshold voltages of the organic light emitting diodes D1 and D2 may also vary. Accordingly, the brightness of the organic light emitting diode may be different from the target brightness, and the lifetime of the organic light emitting diode may be reduced.

SUMMARY

Accordingly, the present invention is directed to an organic light emitting diode display (OLED) and a method of driving the same that substantially obviate one or more of the problems due to limitations and disadvantages of the related art.

An advantage of the present invention is to periodically reduce variances of threshold voltages of a driving thin film transistor and an organic light emitting diode.

Additional features and advantages of the disclosure will be set forth in the description which follows, and in part will be apparent from the description, or may be learned by practice of the disclosure. The advantages of the disclosure will be realized and attained by the structure particularly pointed out in the written description and claims as well as the appended drawings.

To achieve these and other advantages, and in accordance with the purpose of the present invention, as embodied and broadly described herein, a method of driving an organic light emitting diode display that includes a first organic light emitting diode, and a first driving circuit to operate the first organic light emitting diode, the method includes supplying a first gate pulse and a second gate pulse to a first gate line connected to the first driving circuit, and supplying a first data signal and a first compensation signal to a data line connected to the first driving circuit.

In another aspect, an organic light emitting diode display may, for example, include a display panel including a first organic light emitting diode and a first driving circuit to operate the first organic light emitting diode; a gate driver that supplies a first gate pulse and a second gate pulse to a first gate line connected to the first driving circuit; and a data driver that supplies a first data signal and a first compensation signal to a data line connected to the first driving circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION OF THE ILLUSTRATED EMBODIMENTS

Reference will now be made in detail to embodiments, examples of which are illustrated in the accompanying drawings. The same or like reference numbers may be used throughout the drawings to refer to the same or like parts.

Figure 1:
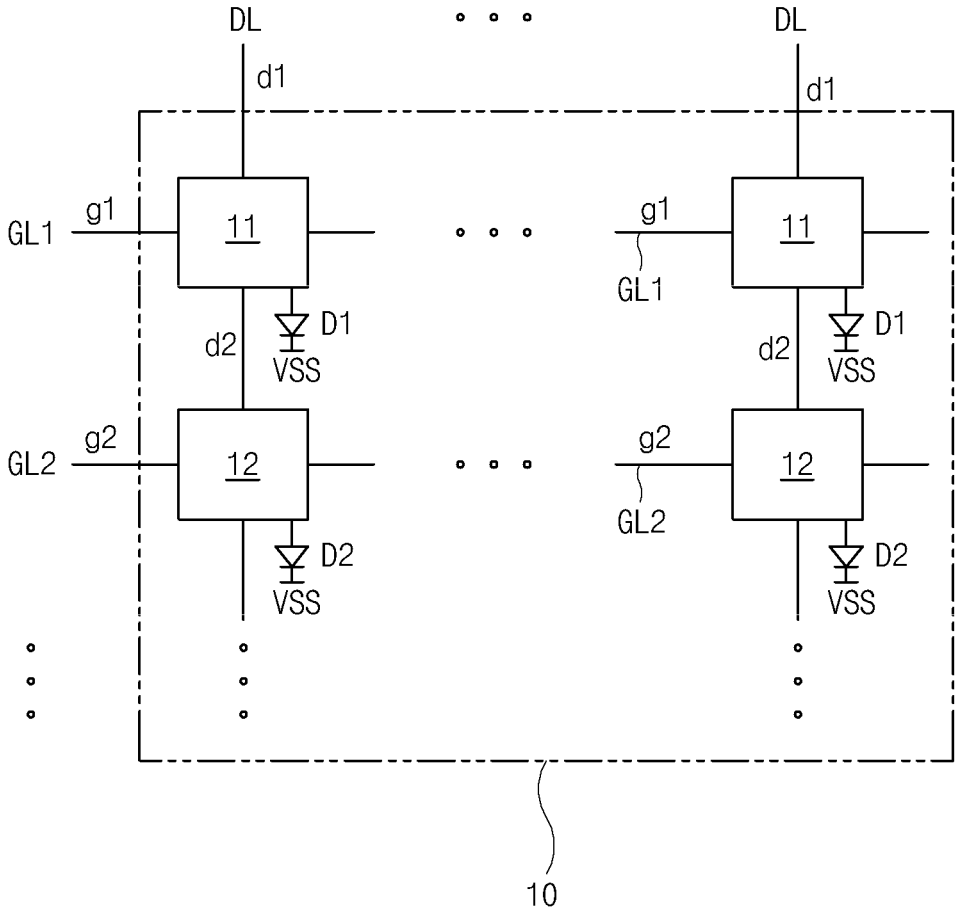
FIG. 1 RELATED ART
FIG. 1 is a view illustrating organic light emitting diodes and driving circuits arranged in respective pixel regions of an OLED according to the related art.
Figure 2:
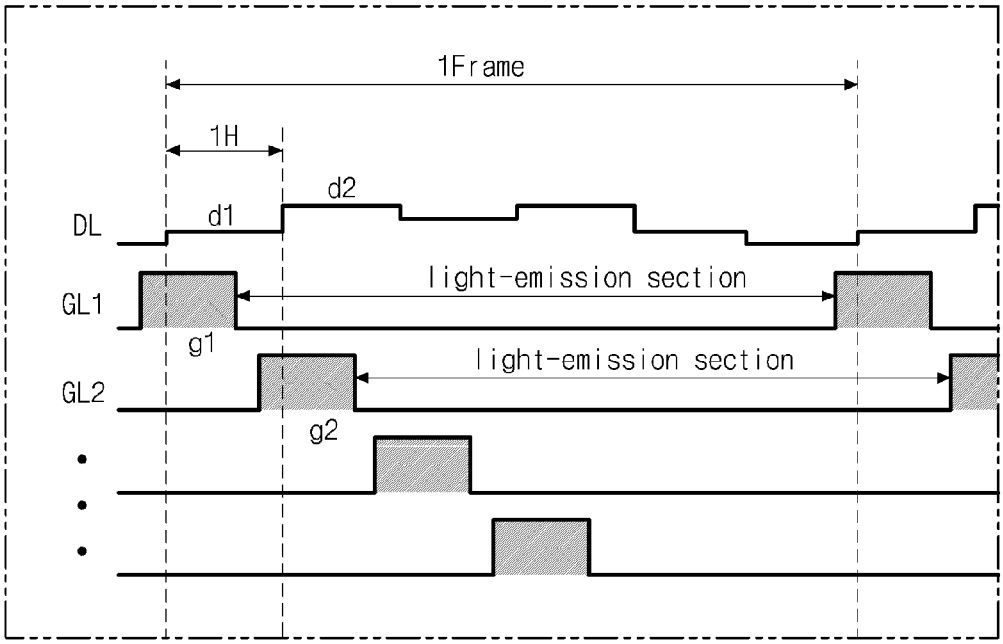
FIG. 2 RELATED ART
FIG. 2 is a timing chart of gate pulses and data signals applied to the driving circuits of FIG. 1.
Figure 3:
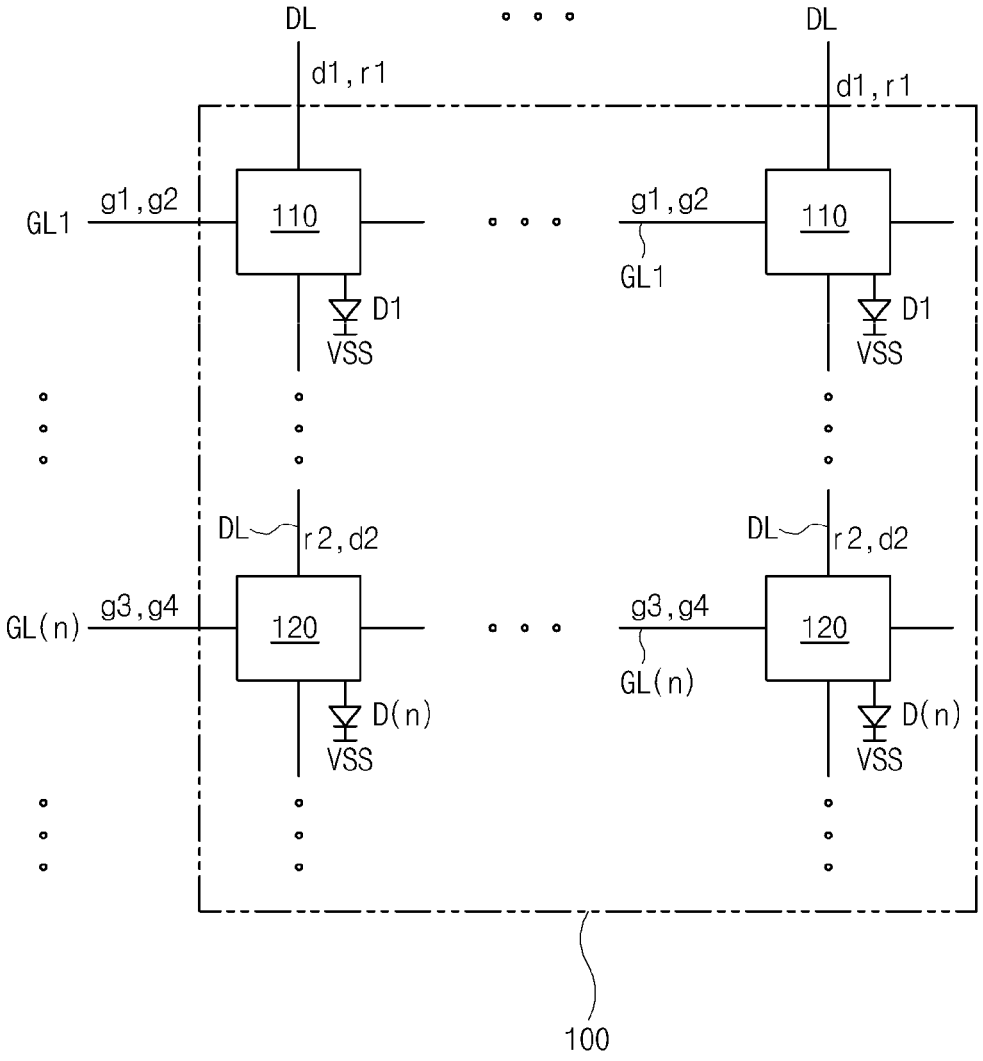
FIG. 3 is a view illustrating organic light emitting diodes and driving circuits arranged in respective pixel regions of an OLED according to an embodiment of the present invention.
Figure 4:
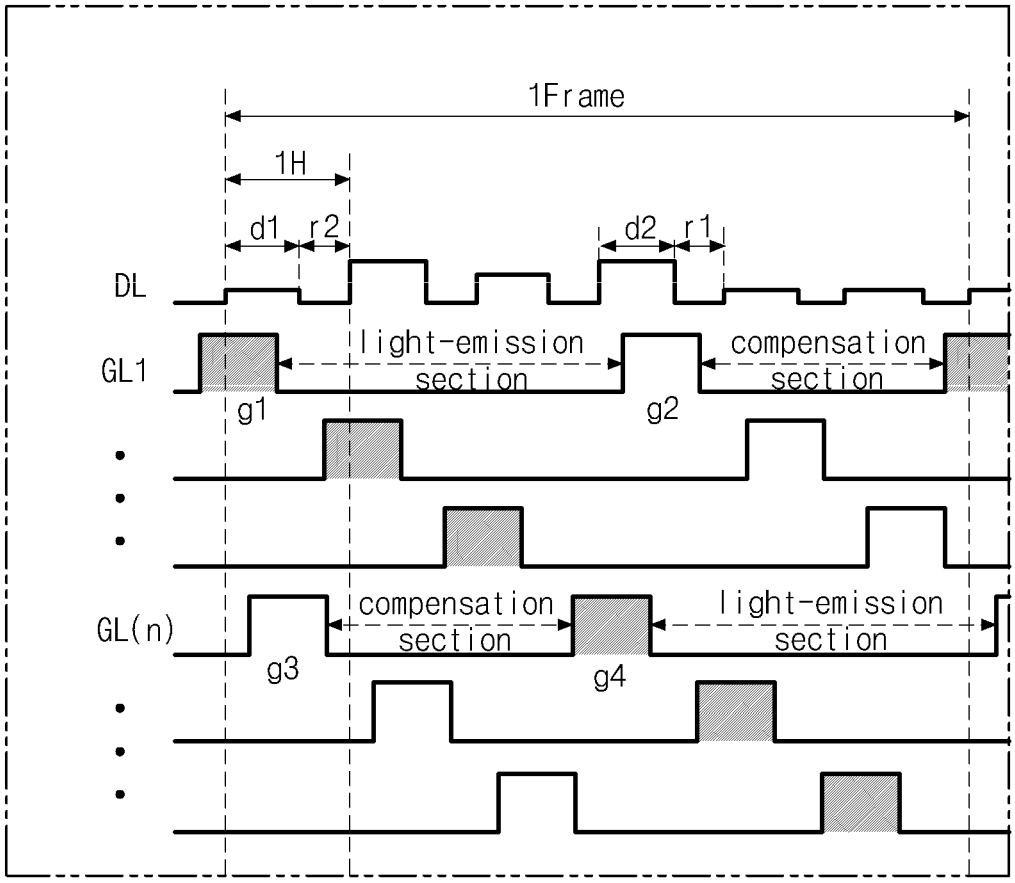
FIG. 4 is a timing chart of gate pulses, data signals and compensation signals applied to the driving circuits of FIG. 3.

FIG. 3 is a view illustrating organic light emitting diodes and driving circuits arranged in respective pixel regions of an OLED according to an embodiment of the present invention, and FIG. 4 is a timing chart of gate pulses, data signals and compensation signals applied to the driving circuits of FIG. 3.

Referring to FIG. 3, the OLED includes first and $n^{th}$ organic light emitting diodes D1 and D(n) and first and $n^{th}$ driving circuits 110 and 120 to operate the first and $n^{th}$ organic light emitting diodes D1 and D(n), respectively, in a display region 100, wherein n is an integer greater than 1.

In detail, the first driving circuit 110 is connected to a first gate line GL1 and each data line DL and operates the first organic light emitting diode D1, and the $n^{th}$ driving circuit 120 is connected to an $n^{th}$ gate line GL(n) and each data line DL and operates the $n^{th}$ organic light emitting diode D(n).

For brevity, the first and $n^{th}$ driving circuits 110 and 120 are shown in FIG. 3. However, a plurality of driving circuits may be arranged between the first and $n^{th}$ driving circuits 110 and 120, and thus a plurality of gate lines may be arranged between the first and $n^{th}$ gate lines GL1 and GL(n) connected to the first and $n^{th}$ driving circuits 110 and 120.

Further, a plurality of driving circuits may be arranged below the $n^{th}$ driving circuit 120, and thus a plurality of gate lines may be arranged below the $n^{th}$ gate line GL(n).

A method of driving the OLED of the embodiment is explained below.

The method of driving the OLED includes sequentially supplying a first gate pulse g1 and a second gate pulse g2 to the first gate line GL1 connected to the first driving circuit 110, and sequentially supplying a first data signal d1 and a first compensation signal r1 to each data line DL connected to the first driving circuit 110.

Further, the method further includes sequentially supplying a third gate pulse g3 and a fourth gate pulse g4 to the $n^{th}$ gate line GL(n) connected to the $n^{th}$ driving circuit 120, and sequentially supplying a second compensation signal r2 and a second data signal d2 to each data line DL connected to the $n^{th}$ driving circuit 120.

Referring to FIG. 4, during a frame interval, the first gate pulse g1 and the second gate pulse g2 are sequentially supplied to the first gate line GL1, and the third gate pulse g3 and the fourth gate pulse g4 are sequentially supplied to the $n^{th}$ gate line GL(n).

In other words, during a frame interval, two gate pulses are sequentially supplied to each gate line.

Further, the first gate pulse g1 and the third gate pulse g3 are sequentially supplied, and the fourth gate pulse g4 and the second gate pulse g2 are sequentially supplied.

In detail, the first gate pulse g1 is supplied to the first gate line GL1, and then the third gate pulse g3 is supplied to the $n^{th}$ gate line GL(n).

Next, the fourth gate pulse g4 is supplied to the $n^{th}$ gate line GL(n), and then the second gate pulse g2 is supplied to the first gate line GL1.

The first to fourth gate pulses g1 to g4 may have the same pulse width.

Further, the first data signal d1 and the second compensation signal r2 are sequentially supplied during a horizontal period H, and the second data signal d2 and the first compensation signal r1 are sequentially supplied during another horizontal period H In other words, during each horizontal period H, each data signal d1 or d2 and each compensation signal r1 or r2 are sequentially supplied to each data line.

A ratio of supplying the first data signal d1 and the second compensation signal r2 may be adjusted, and a ratio of supplying the second data signal d2 and the first compensation signal r1 may be adjusted.

Further, gate pulses supplied to different gate lines may overlap each other, and by sequentially supplying the data signal d1 or d2 and the compensation signal r1 or r2 during one horizontal period H, the data signal d1 or d2 and the compensation signal r1 or r2 interfering with each other can be reduced or prevented. In this regard, for example, the third gate signal g3 may be overlap the first gate signal g1, and the third gate signal g3 may overlap the second compensation signal r2 and the first data signal d1 as well during the corresponding horizontal period H.

In this case, the first and second compensation signals r1 and r2 have voltage levels lower than the first and second data signals d1 and d2.

For example, because the first and second data signals d1 and d2 generally have a voltage level greater than 0V i.e., a positive polarity, the first and second compensation signals r1 and r2 preferably have a voltage level of 0V.

Further, in an overlapping section between the first gate pulse g1 and the first data signal d1, the first data signal d1 is supplied to the first driving circuit 110. In an overlapping section between the second gate pulse g2 and the first compensation signal r1, the first compensation signal r1 is supplied to the first driving circuit 110.

Further, in an overlapping section between the third gate pulse g3 and the second compensation signal r2, the second compensation signal r2 is supplied to the $n^{th}$ driving circuit 120. In an overlapping section between the fourth gate pulse g4 and the second data signal d2, the second data signal d2 is supplied to the $n^{th}$ driving circuit 120.

Further, in a light-emission section from a falling point of the first gate pulse g1 to a rising point of the second gate pulse g2, the first organic light emitting diode D1 emits light. In a compensation section from a falling point of the second gate pulse g2 to a rising point of a first gate pulse g1 of the next frame, the first organic light emitting diode D1 does not emit light.

Further, in a compensation section from a falling point of the third gate pulse g3 to a rising point of the fourth gate pulse g4, the $n^{th}$ organic light emitting diode D(n) does not emit light. In a light-emission section from a falling point of the fourth gate pulse g4 to a rising point of a third gate pulse g3 of the next frame, the $n^{th}$ organic light emitting diode D(n) emits light.

Further, a ratio of the light-emission section and the compensation section may be adjusted according to a ratio of supplying the data signal d1 or d2 and the compensation signal r1 or r2. Further, when adjusting the ratio of the light-emission section and the compensation section, the third gate signal g3 may not overlap the first gate signal g1 (e.g., the third gate signal g3 and the first gate signal g1 may be at different horizontal periods), and the second compensation signal r2 by the third gate signal g3 may not be immediately next to the first data signal d1 by the first gate signal g1 (e.g., the second compensation signal r2 and the first data signal d1 may be at different horizontal periods).

As illustrated in FIG. 3, the first driving circuit 110 is supplied with the first data signal d1 and the first compensation signal r1 by the first gate pulse g1 and the second gate pulse g2, and the $n^{th}$ driving circuit 120 is supplied with the second compensation signal r2 and the second data signal d2 by the third gate pulse g3 and the fourth gate signal g4.

In detail, the first driving circuit 110 is supplied with the first gate pulse g1 from the first gate line GL1 and the first data signal d1 from the data line DL to make the first organic light emitting diode D1 emit light, and then is supplied with the second gate pulse g2 from the first gate line GL1 and the first compensation signal r1 from the data line DL to make the first organic light emitting diode D1 not emit light Further, the $n^{th}$ driving circuit 120 is supplied with the third gate pulse g3 from the $n^{th}$ gate line GL(n) and the second compensation signal r2 from the data line DL to make the $n^{th}$ organic light emitting diode D(n) not emit light, and then is supplied with the fourth gate pulse g4 from the $n^{th}$ gate line GL(n) and the second data signal d2 from the data line DL to make the $n^{th}$ organic light emitting diode D(n) emit light.

Accordingly, the method of driving the OLED of the embodiment substantially divides one frame into a light-emission section during which the first or $n^{th}$ organic light emitting diode D1 or D(n) emits light, and a compensation section during which the first or $n^{th}$ organic light emitting diode D1 and D(n) does not emit light. In the compensation section, the first or second compensation signal r1 or r2 having a voltage level lower than the first or second data signal d1 or d2 is supplied to the first or $n^{th}$ driving circuit 110 or 120, and thus a variance of a threshold voltage of a driving thin film transistor of the first or $n^{th}$ driving circuit 110 or 120 and a variance of a threshold voltage of the first or $n^{th}$ organic light emitting diodes D1 or D(n), which may be caused by a voltage corresponding to the first or second data signal d1 or d2, can be reduced periodically.

FIGS. 5A to 5D are views illustrating an organic light emitting diode and a driving circuit of one pixel of an OLED according to an embodiment of the present invention.

For brevity, a pixel including a first organic light emitting diode D1 and a first driving circuit 110 are illustrated. Other pixels including an $n^{th}$ organic light emitting diode (D(n) of FIG. 3) and an nth driving circuit (120 of FIG. 3) have the same configuration as the pixel in FIGS. 5A to 5D.

Referring to FIGS. 5A to 5D, the first driving circuit 110 includes a driving thin film transistor DT, a switching thin film transistor SWT, a sensing thin film transistor SST and a capacitor C.

In detail, the first organic light emitting diode D1 includes an anode connected to a first node N1, and a cathode supplied with a low power voltage VSS.

The first organic light emitting diode D1 generates light having a brightness corresponding to a drain current Ids supplied from the driving thin film transistor DT.

Further, the driving thin film transistor DT includes a gate electrode G connected to a switching thin film transistor SWT, a source electrode S connected to the first node N1, and a drain electrode D supplied with a high power voltage VDD greater than the low power voltage VSS.

When the driving thin film transistor DT is supplied with a first data signal d1 from the switching thin film transistor SWT, a drain current Ids, which is generated according to a voltage between the gate electrode G and the source electrode S of the driving thin film transistor DT, flows into the first node N1.

Further, the switching thin film transistor SWT includes a gate electrode G connected to a first gate line GL1, a source electrode S connected to a data line DL, and a drain electrode D connected to the gate electrode G of the driving thin film transistor DT.

The switching thin film transistor SWT is supplied with a first or second gate pulses g1 or g2 and turned on, and thus a first data signal d1 or a first compensation signal r1 is supplied to the driving thin film transistor DT.

Further, the sensing thin film transistor SST includes a gate electrode G connected to a first sensing driving line SL1, a source electrode S connected to the first node N1, and a drain electrode D connected to a sensing sync line SSL.

The sensing thin film transistor SST is to reset (or initialize) a current flowing on the first node N1 according to a reference voltage Vref supplied through the sensing sync line SSL.

Further, the capacitor C is connected between the first node N1 and the gate electrode G of the driving thin film transistor DT.

The capacitor C stores (or, is charged with) voltages corresponding to a first data signal d1 and the first compensation signal r1, respectively, and maintains the stored voltages during a frame interval.

Timings of the signals supplied to the first driving circuit 110 are explained below with reference to FIGS. 5A to 5D and FIG. 6.

Figure 5A:
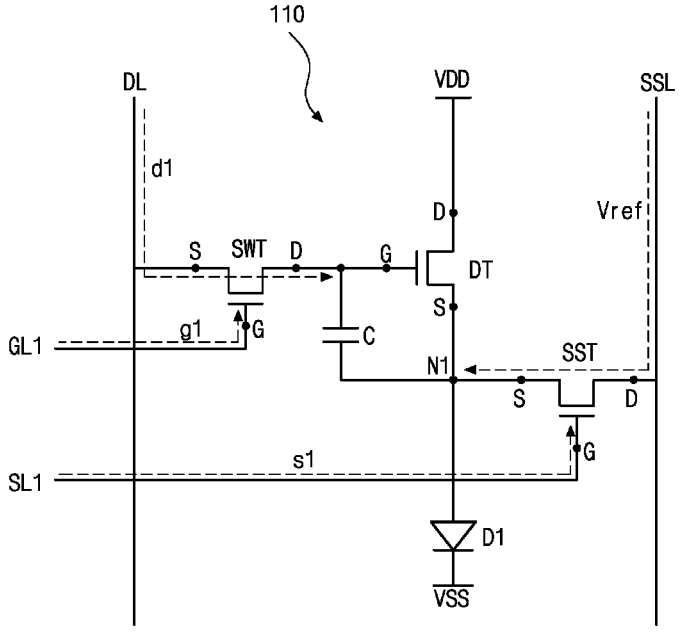
FIGS. 5A to 5D are views illustrating an organic light emitting diode and a driving circuit of one pixel of an OLED according to an embodiment of the present invention.
Figure 5B:
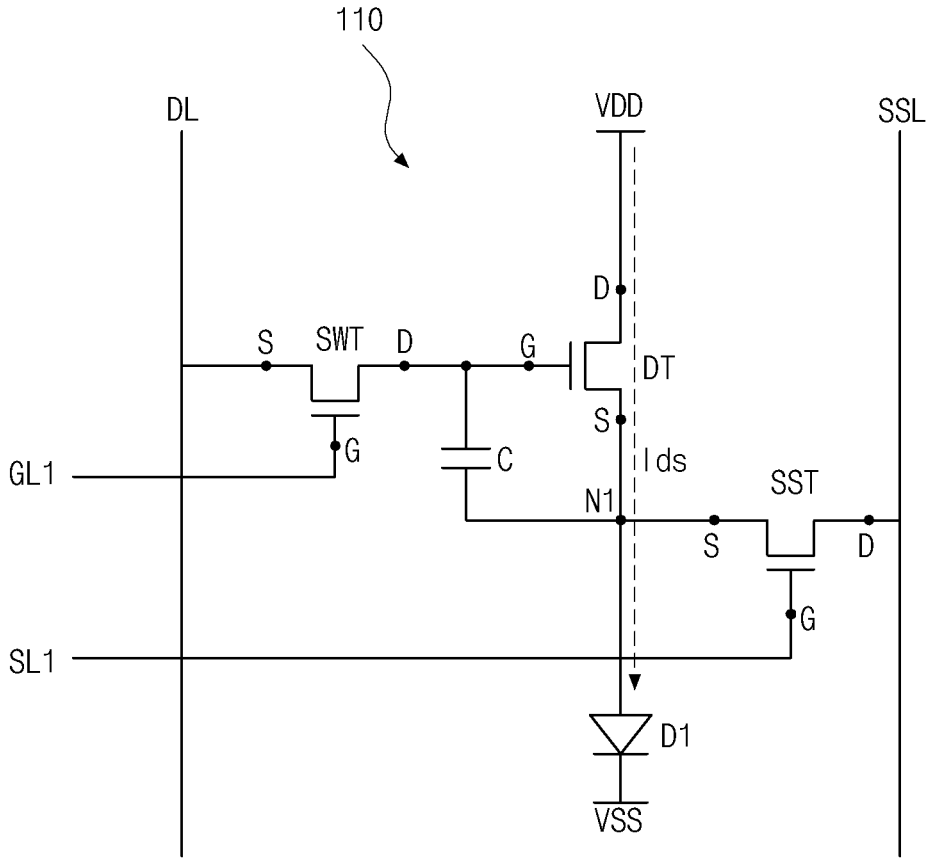
Figure 5C:
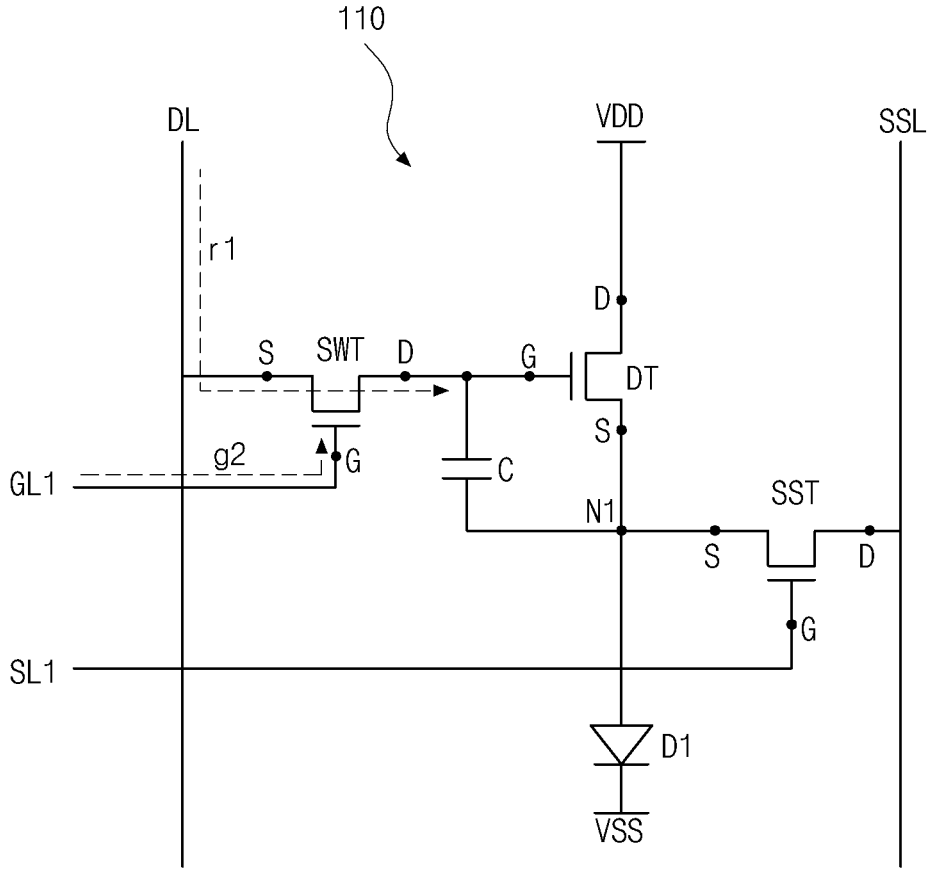
Figure 5D:
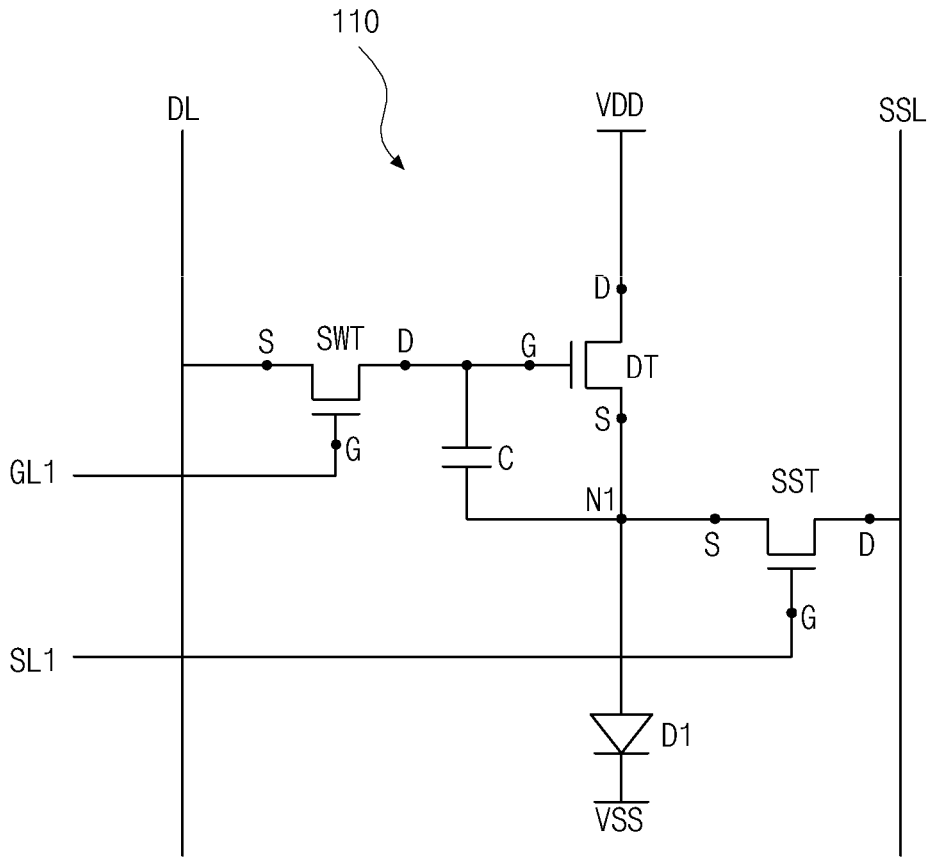

FIG. 5A shows signals supplied to the first driving circuit 110 during a charging section of the first data signal d1, FIG. 5B shows signals supplied to the first driving circuit 110 during a light-emission section of the first organic light emitting diode D1, FIG. 5C shows signals supplied to the first driving circuit 110 during a charging section of the first compensation signal r1, and FIG. 5D shows signals supplied to the first driving circuit 110 during a compensation section of the driving thin film transistor.

Figure 6:
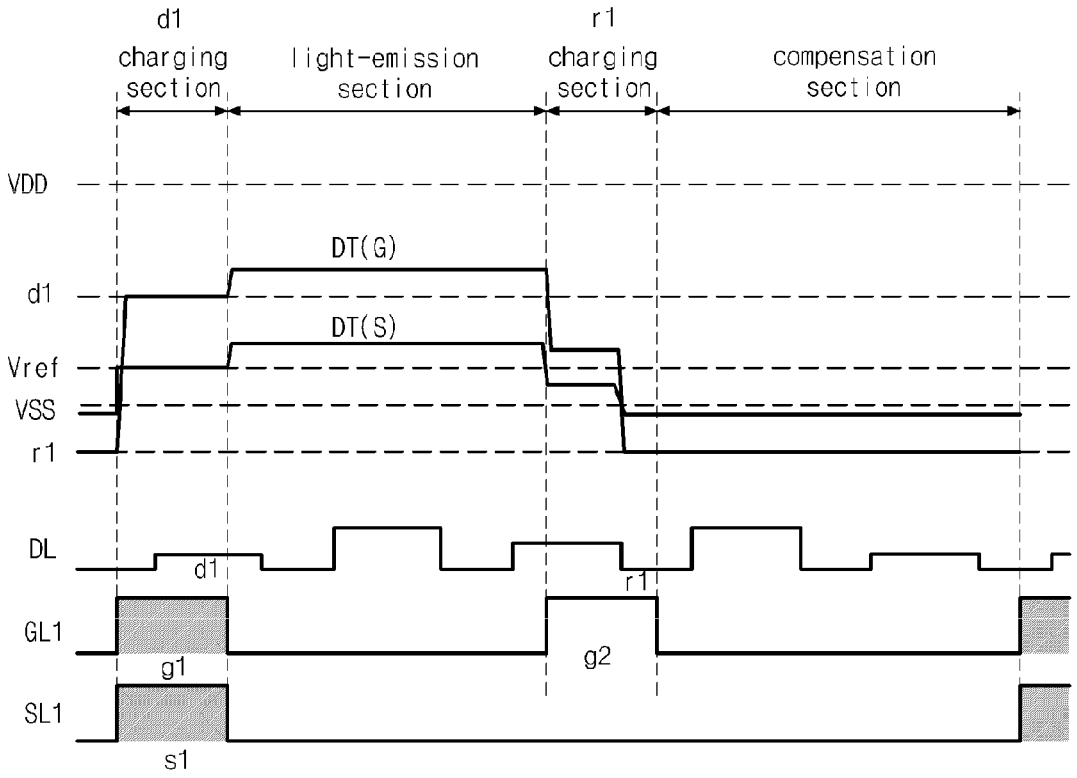
FIG. 6 is a timing chart of signals, including a gate pulse, a data signal and a compensation signal, supplied to the driving circuit of FIGS. 5A to 5D.

FIG. 6 is a timing chart of signals, including a gate pulse, a data signal and a compensation signal, supplied to the driving circuit of FIGS. 5A to 5D.

First, during the charging section of the first data signal d1, the switching thin film transistor SWT is turned on by the first gate pulse g1 supplied through the first gate line GL1, and the first data signal d1 from the data line DL is supplied to the gate electrode G of the driving thin film transistor DT.

At the same timing as the first gate pulse g1, the sensing thin film transistor SST is turned on by a sensing signal s1 supplied through the first sensing driving line SL1, and the reference voltage Vref from the sensing sync line SSL is supplied to the first node N1, the source electrode S of the driving thin film transistor DT.

With the capacitor C, the gate electrode G and the source electrode S of the driving thin film transistor DT are charged with a voltage corresponding to the first data signal d1 and the reference voltage Vref, respectively.

Next, during the light-emission section of the first organic light emitting diode D1, the switching thin film transistor SWT and the sensing thin film transistor SST are turned off. The voltage corresponding to the first data signal d1 and the reference voltage Vref at the gate electrode G and the source electrode S of the driving thin film transistor DT are boosted, and the drain current Ids according to the voltages at the gate electrode G and the source electrode S of the driving thin film transistor DT flows onto the first node N1.

In this case, the first organic light emitting diode D1 emits light having a brightness according to a level of the drain current Ids.

Next, during the charging section of the first compensation signal r1, the switching thin film transistor SWT is turned on by the second gate pulse g2 supplied through the first gate line GL1, and the first compensation signal r1 from the data line DL is supplied to the gate electrode G of the driving thin film transistor DT.

During the charging section, the sensing thin film transistor SST is turned off.

Accordingly, with the capacitor C, the gate electrode G and the source electrode S of the driving thin film transistor DT are charged with a voltage lower than the voltage corresponding to the first data signal r1 and a voltage lower than the reference voltage Vref, respectively.

Next, during the compensation section of the driving thin film transistor DT, the switching thin film transistor SWT is turned off. Accordingly, with the capacitor C, the gate electrode G and the source electrode S of the driving thin film transistor DT are charged with a voltage corresponding to the first compensation signal r1 and a voltage lower than the low power voltage VSS, respectively.

The first compensation signal r1 has a voltage level lower than the first data signal d1.

Accordingly, the method of driving the OLED according to an embodiment divides one frame into the light-emission section when the first organic light emitting diode D1 emits light, and the compensation section when the first organic light emitting diode D1 does not emit light. During the compensation section, the first compensation signal r1 having a voltage level lower than the first data signal d1 is supplied to the first driving circuit 110, and thus a variance of a threshold voltage of the driving thin film transistor DT and a variance of a threshold voltage of the first organic light emitting diode D1, which are caused by the voltage corresponding to the first data signal d1, can be reduced periodically.

It will be apparent to those skilled in the art that various modifications and variations can be made in a display device of the present invention without departing from the sprit or scope of the disclosure. Thus, it is intended that the present invention covers the modifications and variations of this disclosure provided they come within the scope of the appended claims and their equivalents.

What is claimed is:

1. A method of driving an organic light emitting diode display that includes a first organic light emitting diode, and a first driving circuit to operate the first organic light emitting diode, the method comprising:

sequentially supplying a first gate pulse in a first charging section and a second gate pulse in a second charging section to a first gate line connected to the first driving circuit, the first gate pulse not overlapping the second gate pulse; and supplying a first data signal in the first charging section and a first compensation signal in the second charging section to a data line connected to the first driving circuit, wherein the first driving circuit includes a switching thin film transistor, a source electrode and a gate electrode of which are connected to the data line and the first gate line, and a driving thin film transistor connected to a drain electrode of the switching thin film transistor, wherein the first data signal is boosted during a light-emission section from a falling point of the first gate pulse of the first charging section to a rising point of the second gate pulse of the second charging section.

2. The method of claim 1, wherein the organic light emitting diode display further includes a $n^{th}$ organic light emitting diode, and a $n^{th}$ driving circuit to operate the $n^{th}$ organic light emitting diode, where n is an integer of 2 or greater, the method further comprising:

supplying a third gate pulse and a fourth gate pulse to a $n^{th}$ gate line connected to the $n^{th}$ driving circuit; and supplying a second compensation signal and a second data signal to a data line connected to the $n^{th}$ driving circuit.

3. The method of claim 1, wherein the first data signal and the first compensation signal are sequentially supplied to the data line connected to the first driving circuit.

4. The method of claim 2, wherein the third gate pulse and the fourth gate pulse are sequentially supplied to the $n^{th}$ gate line connected to the $n^{th}$ driving circuit, and the second compensation signal and the second data signal are sequentially supplied to the data line connected to the $n^{th}$ driving circuit.

5. The method of claim 2, wherein the first and second gate pulses are supplied during one frame, and the third and fourth gate pulses are supplied during one frame.

6. The method of claim 2, wherein the first data signal and the second compensation signal are sequentially supplied during one horizontal period, and the second data signal and the first compensation signal are sequentially supplied during one horizontal period.

7. The method of claim 2, wherein the first and second compensation signals have a voltage level lower than the first and second data signals.

8. The method of claim 2, wherein the first and third gate pulses are sequentially supplied, and the fourth and second gate pulses are sequentially supplied.

9. The method of claim 2, wherein the first driving circuit is supplied with the first data signal and the first compensation signal by the first gate pulse and the second gate pulse, respectively, and the $n^{th}$ driving circuit is supplied with the second compensation signal and the second data signal by the third gate pulse and the fourth gate pulse, respectively.

10. The method of claim 2, wherein the third gate signal overlaps the first gate signal, and the third gate signal overlaps the first data signal and the second compensation signal.

11. The method of claim 2, wherein the organic light emitting diode display further includes:

a gate driver that supplies the first gate pulse and the second gate pulse to the first gate line connected to the first driving circuit; and a data driver that supplies the first data signal and the first compensation signal to the data line connected to the first driving circuit.

12. The method of claim 10, wherein the gate driver supplies the third gate pulse and the fourth gate pulse to the $n^{th}$ gate line connected to the $n^{th}$ driving circuit, and wherein the data driver supplies the second compensation signal and the second data signal to the data line connected to the $n^{th}$ driving circuit.

13. An organic light emitting diode display, comprising:

a display panel including a first organic light emitting diode and a first driving circuit to operate the first organic light emitting diode;

a gate driver that sequentially supplies a first gate pulse in a first charging section and a second gate pulse in a second charging section to a first gate line connected to the first driving circuit, the first gate pulse not overlapping the second gate pulse; and a data driver that supplies a first data signal in the first charging section and a first compensation signal in the second charging section to a data line connected to the first driving circuit, wherein the first driving circuit includes a switching thin film transistor, a source electrode and a gate electrode of which are connected to the data line and the first gate line, and a driving thin film transistor connected to a drain electrode of the switching thin film transistor, wherein the first data signal is boosted during a light-emission section from a falling point of the first gate pulse of the first charging section to a rising point of the second gate pulse of the second charging section.

14. The display of claim 13, wherein the display panel further includes a $n^{th}$ organic light emitting diode and a $n^{th}$ driving circuit to operate the $n^{th}$ organic light emitting diode, where n is an integer of 2 or greater, wherein the gate driver supplies a third gate pulse and a fourth gate pulse to a $n^{th}$ gate line connected to the $n^{th}$ driving circuit, and wherein the data driver supplies a second compensation signal and a second data signal to a data line connected to the $n^{th}$ driving circuit.

15. The display of claim 13, wherein the data driver sequentially supplies the first data signal and the first compensation signal to the data line connected to the first driving circuit.

16. The display of claim 14, wherein the gate driver sequentially supplies the third gate pulse and the fourth gate pulse to the $n^{th}$ gate line connected to the $n^{th}$ driving circuit, and wherein the data driver sequentially supplies the second compensation signal and the second data signal to the data line connected to the $n^{th}$ driving circuit.

17. The display of claim 14, wherein the first and second gate pulses are supplied during one frame, and the third and fourth gate pulses are supplied during one frame.

18. The display of claim 14, wherein the first data signal and the second compensation signal are sequentially supplied during one horizontal period, and the second data signal and the first compensation signal are sequentially supplied during one horizontal period.

19. The display of claim 14, wherein the first and second compensation signals have a voltage level lower than the first and second data signals.

20. The display of claim 14, wherein the first and third gate pulses are sequentially supplied, and the fourth and second gate pulses are sequentially supplied.

21. A method of driving an organic light emitting diode display including a first organic light emitting diode and a first driving circuit having a switching thin film transistor (SWT), a driving thin film transistor (DT) and a sensing thin film transistor (SST) comprising:

supplying a first gate pulse to a first gate line of the switching thin film transistor (SWT) and supplying a first data signal through a data line to a gate electrode of the driving thin film transistor (DT) and supplying a sensing signal to a first sensing driving line and supplying a reference voltage through a sensing sync line to a source electrode of the driving thin film transistor (DT) during a first charging section of the first data signal in one frame;

boosting the first data signal at the gate electrode of the driving thin film transistor (DT) and the reference voltage at the source electrode of the driving thin film transistor (DT) and having the first organic light emitting diode emitting light according to a level of a drain current flow between voltages at the gate electrode and the source electrode of the driving thin film transistor (DT) during a light-emission section in one frame;

supplying a second gate pulse to the first gate line of the switching thin film transistor (SWT) and supplying a first compensation signal through the data line to the gate electrode of the driving thin film transistor (DT) and supplying a first compensation signal to the data line during a second charging section of the first compensation signal in one frame; and charging the gate electrode and the source electrode of the driving thin film transistor (DT) with a voltage corresponding to the first compensation signal having a lower voltage level than the first data signal during a compensation section of the driving thin film transistor (DT) in one frame.

22. The method of claim 21, wherein the charging the gate electrode and the source electrode of the driving thin film transistor (DT) with the voltage of the first compensation signal is to reduce a variance of a threshold voltage of the first organic light emitting diode caused by the voltage corresponding to the first data signal.

23. The method of claim 21, wherein the first data signal and the first compensation signal are sequentially supplied to the data line connected to the first driving circuit.

24. The method of claim 23, wherein the first data signal and the first compensation signal are sequentially supplied during one horizontal period.

25. The method of claim 21, wherein the driving thin film transistor (DT) includes a gate electrode connected to the switching thin film transistor (SWT), a source electrode connected to a first node N1 and a drain electrode supplied with a high power voltage VDD greater than a low power voltage VSS, wherein the voltage level of the first compensation signal is lower than a low power voltage VSS.

26. The method of claim 21, wherein the first compensation signal has a voltage level of 0V.

* * * * *